US006668712B1

(12) United States Patent
Gervais

(10) Patent No.: US 6,668,712 B1
(45) Date of Patent: Dec. 30, 2003

(54) PORTABLE CRUSHER

(75) Inventor: Joseph Lucien Fernand Gervais, Manitouwadge (CA)

(73) Assignee: 1401310 Ontario Limited, Thunder Bay (CA)

( * ) Notice: Subject to any disclaimer, the term of this patent is extended or adjusted under 35 U.S.C. 154(b) by 0 days.

(21) Appl. No.: 09/402,947

(22) PCT Filed: Apr. 9, 1998

(86) PCT No.: PCT/CA98/00349

§ 371 (c)(1),
(2), (4) Date: Feb. 1, 2000

(87) PCT Pub. No.: WO98/45043

PCT Pub. Date: Oct. 15, 1998

(30) Foreign Application Priority Data

Apr. 10, 1997 (GB) ..... 9707289

(51) Int. Cl.[7] ..... B30B 15/00; B02C 1/06

(52) U.S. Cl. ..... 100/100; 100/215; 100/218; 100/233; 241/264; 241/268

(58) Field of Search ..... 100/91, 100, 215, 100/218, 233, 901; 37/411, 412, 904, 403; 241/262, 264, 265, 266, 267, 268, 269

(56) References Cited

U.S. PATENT DOCUMENTS

| | | | | | |
|---|---|---|---|---|---|
| 3,894,698 | A | * | 7/1975 | Falk | 241/264 |
| 3,918,648 | A | * | 11/1975 | Anthony | 241/268 |
| 4,398,674 | A | * | 8/1983 | Dremann | 241/264 |
| 4,441,415 | A | * | 4/1984 | Hawkins | 100/100 |
| 4,637,562 | A | * | 1/1987 | Hagiwara et al. | 241/268 |
| 4,899,942 | A | * | 2/1990 | Bohringer | 241/265 |
| 5,110,058 | A | * | 5/1992 | Rawson | 241/264 |
| 5,765,769 | A | * | 6/1998 | Kaya | 241/264 |
| 5,802,747 | A | * | 9/1998 | Nojima | 37/403 |
| 5,878,969 | A | * | 3/1999 | Kaya | 241/268 |
| 6,058,632 | A | * | 5/2000 | Hawkins | 37/904 |

* cited by examiner

*Primary Examiner*—John Sipos
*Assistant Examiner*—Louis Huynh

(57) ABSTRACT

A portable rock crusher (10)is adapted for attachment to a boom (16) of an earthmoving vehicle (14). The crusher has a hopper (32) with a material inlet (49) and a material outlet (44) spaced from the inlet. A pair of jaws (46,48) is located within the hopper and positioned between the inlet and outlet. The jaws are movable relative to one another to vary the spacing therebetween and an actuator (68) is provided to control relative movement between the jaws. Material moving from the inlet to the outlet thereby passes between the jaws and is crushed upon relative movement of the jaws to provide an aggregate at the outlet.

4 Claims, 6 Drawing Sheets

PORTABLE CRUSHER

BACKGROUND OF THE INVENTION

The present invention relates to a portable crushing device for preparing aggregate and the like.

When developing a remote site such as a mine or quarry, it is necessary to provide or improve roadways either leading to the site or within the site itself. Such roadways are necessary to allow the equipment used ill developing the site to move freely and typically the roads are made from crushed rock that can be deposited, smoothed and compacted to provide a serviceable roadway.

However, the very remoteness of or poor access to the site may make it impractical to have a rock crusher conveniently located to produce the aggregate for making a roadway. Moreover, a conventional mobile rock crushing plant may be too large or heavy for use within the site until such time as the roads have been developed.

In most locations there is an ample supply of blasted stone available but it may be impractical or uneconomical to have a rock crusher located at the site. Even if a crusher is available, it is inconvenient to carry the blasted rock from the mine or quarry, crush it to a size suitable for building a road, and then transport it back to the mine for building a roadway.

BRIEF DESCRIPTIONS OF DOCUMENTS D1 AND D2

In U.S. Pat. No. 4,441,415 there is taught a crusher adapted for crushing or flattening scrap metal and, particularly, auto body shells. The crusher is mounted on a tractor and includes a pair of crushing jaws. One of the jaws is stationary while the other is pivotally mounted with the pivot point positioned at the outlet of the crusher. The relative motion of the jaws is accomplished by means of hydraulic cylinders acting directly oil the moving jaw. This reference does not teach a crusher for aggregate material.

U.S. Pat. No. 3,959,897 teaches a rock crusher adapted for mounting on a dredging device. The crusher includes a pair of jaws, one being stationary and the other pivotally mounted and acted upon by a hydraulic cylinder. The pivot point for tile moving jaw is located near the outlet of the crusher and the cylinder acts through an eccentric shaft. It is therefore an object of the present invention to obviate or mitigate the above disadvantages.

SUMMARY OF THE INVENTION

In general terms, the present invention provides a portable crusher for attachment to a boom of an earthmoving vehicle. The crusher has a hopper with a material inlet and a material outlet spaced from the inlet. A pair of jaws is located within the hopper and positioned between the inlet and outlet. The jaws are movable relative to one another to vary the spacing therebetween and an actuator is provided to control relative movement between the jaws. Material moving from the inlet to the outlet thereby passes between the jaws and is crushed upon relative movement of the jaws to provide an aggregate at the outlet.

BRIEF SUMMARY OF THE INVENTION

Preferably the actuator is a hydraulic actuator and one of the jaws is fixed while the other may pivot relative to the hopper under the control of the actuator.

It is also preferred that the jaws are biased apart and that the biasing is provided by a mechanical spring.

By providing a crusher that may be attached to the boom of an earthmoving vehicle, it is possible to transport the crusher prior to improvement of the roads to the location at which the raw materials are available for crushing into aggregate. Moreover, the feed of material between the inlet and outlet may be controlled by operation of the boom-leveling mechanism and the hopper may be utilized to transport the crushed material if convenient. Thus, the invention provides a portable crusher comprising:

- a hopper having a material inlet and a material outlet spaced from the inlet;
- a pair of jaws within the hopper positioned between the inlet and outlet, the jaws being moveable relative to one another, whereby material moving from the inlet to the outlet passes between the jaws and is crushed; and
- an actuator to effect the relative movement between the jaws;
- wherein the pair of jaws comprise a first, moveable jaw, connected to the actuator, and a second, stationary jaw, the first jaw having a first end at the inlet and a second end at the outlet;

the improvement comprising the first end of the first jaw being pivotally connected to the hopper and the second end of the first jaw being connected to the actuator.

BRIEF DESCRIPTION OF THE DRAWINGS

Embodiments of the invention will now be described by way of example only with reference to the accompanying drawings, in which.

DESCRIPTION OF THE PREFERRED EMBODIMENTS

Figure 1:
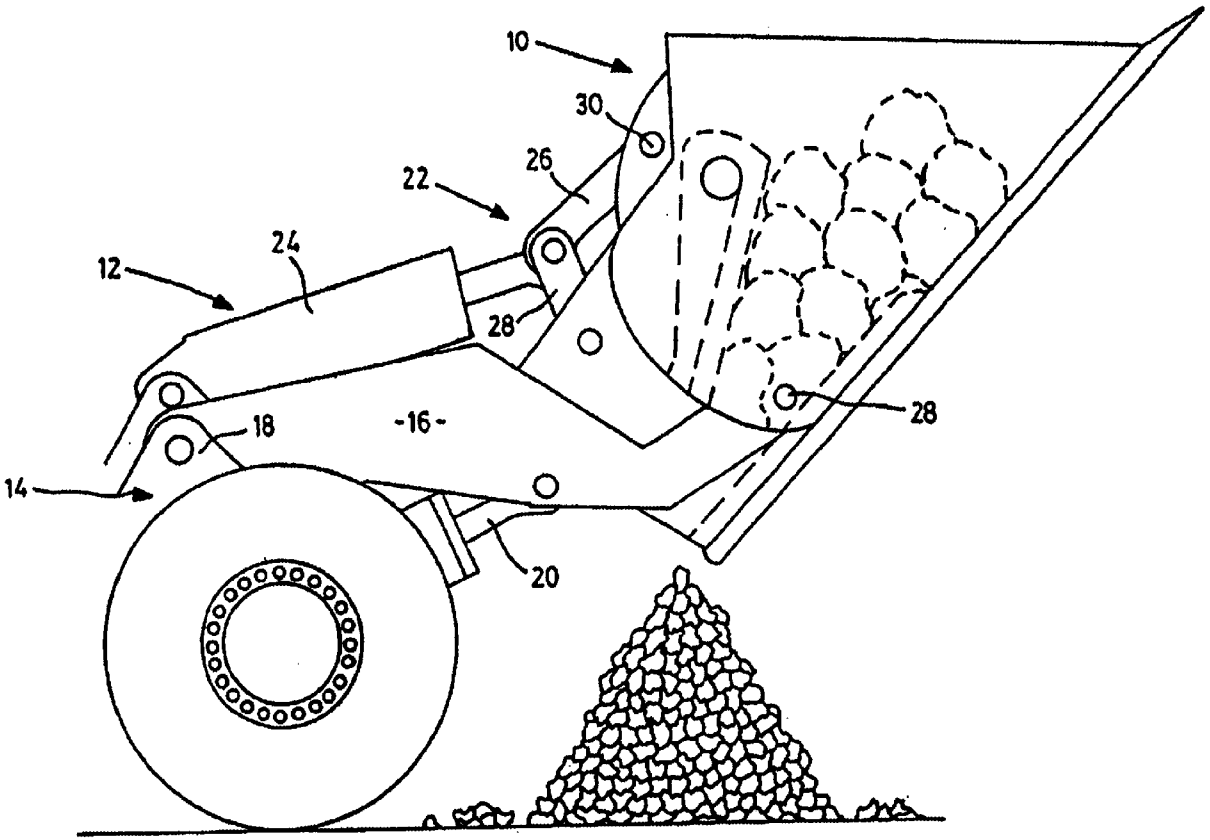
FIG. 1 is a side elevation of a hydraulic crusher mounted on a wheeled vehicle.

Referring therefore to FIG. 1, a hydraulic crusher 10 is connected to a boom assembly 12 of a wheeled earthmoving vehicle 14. The boom assembly 12 includes a pair of laterally spaced booms 16 pivotally connected to towers 18 and movable about the pivot point with the towers by means of lift cylinders 20. The boom assembly 12 also includes a leveling linkage 22 comprising a leveling cylinder 24 connected to a pair of links 26, 28. The boom assembly 12 and wheeled vehicle 14 are conventional and well known in the earthmoving field and need not be described in further detail. It will of course be understood that other configurations of wheeled vehicle or tracked vehicle may be utilized to support the crusher 10.

The crusher 10 is provided with mounting points 28, 30 for connection through respective pins to the lift arms, or booms, 16 and link 26. In configuration, the mounting points 28, 30 correspond to those of a conventional bucket such as may be used with the boom assembly 12 so that the vehicle 14 may be used with the crusher 10 or with a conventional bucket assembly.

Figure 2:
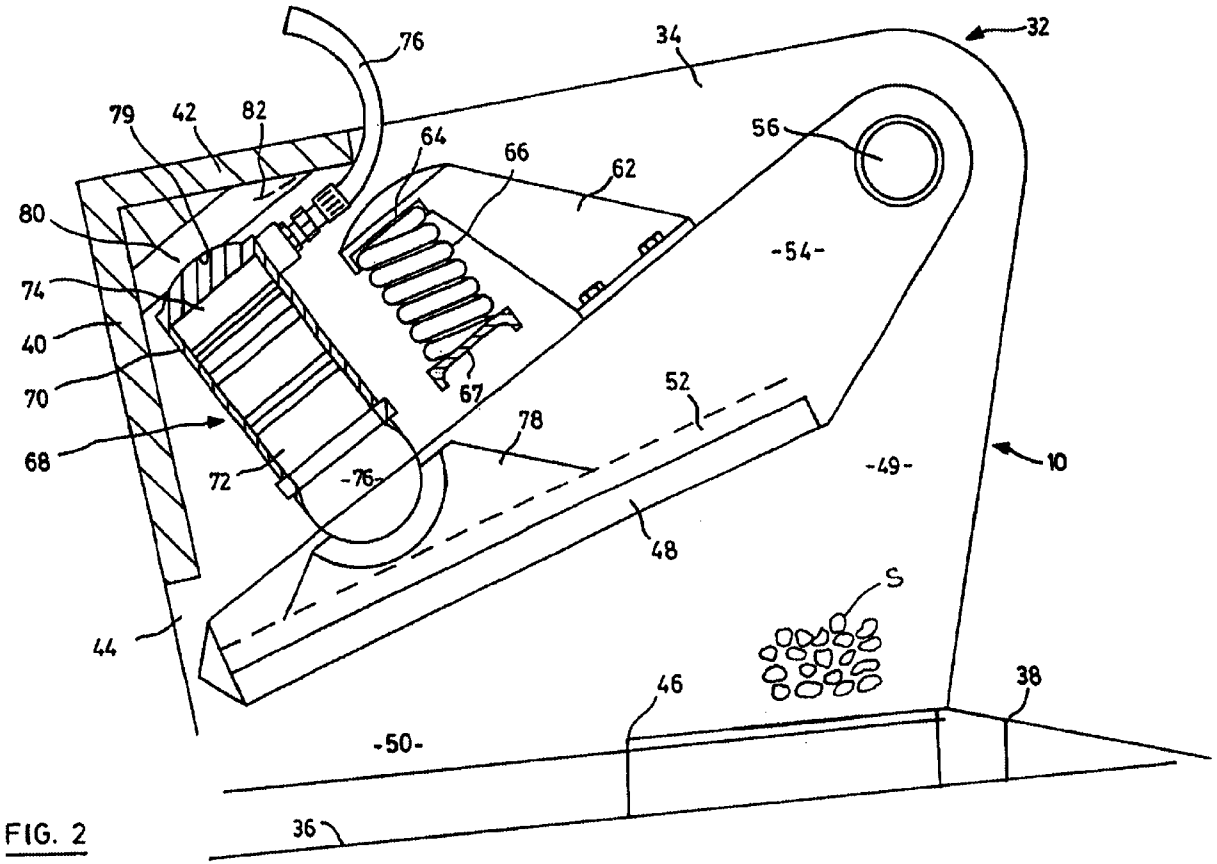
FIG. 2 is a section of the crusher shown in FIG. 1.

Referring to FIG. 2, the crusher assembly 10 comprises a hopper generally indicated at 32 and having a pair of laterally spaced side walls 34 interconnected by a floor 36. The floor 36 projects forwardly from the side walls 34 to provide a tapered lip 38 to facilitate ingress of material into the hopper 32. The side walls 34 are also connected at the upper rear edge by a rear wall 40 and a top wall 42. The end wall 40 terminates prior to the floor 36 to provide a transverse elongate outlet 44.

A pair of jaws 46, 48 is located within the hopper 32 with the lower jaw 46 secured through bolts 50 to the floor 36. The jaw 48 is secured to a transverse plate 52 which extends between a pair of arms 54. The arms 54 are located adjacent respective side walls 34 and are pivotally mounted to the side walls on pins 56. The jaw 48 may therefore pivot about the pins 56 toward and away from the jaw 46. The forward end of the jaws 46, 48 are thus spaced apart to define an inlet 49 that is aligned with but spaced from the outlet 44.

Figure 3:
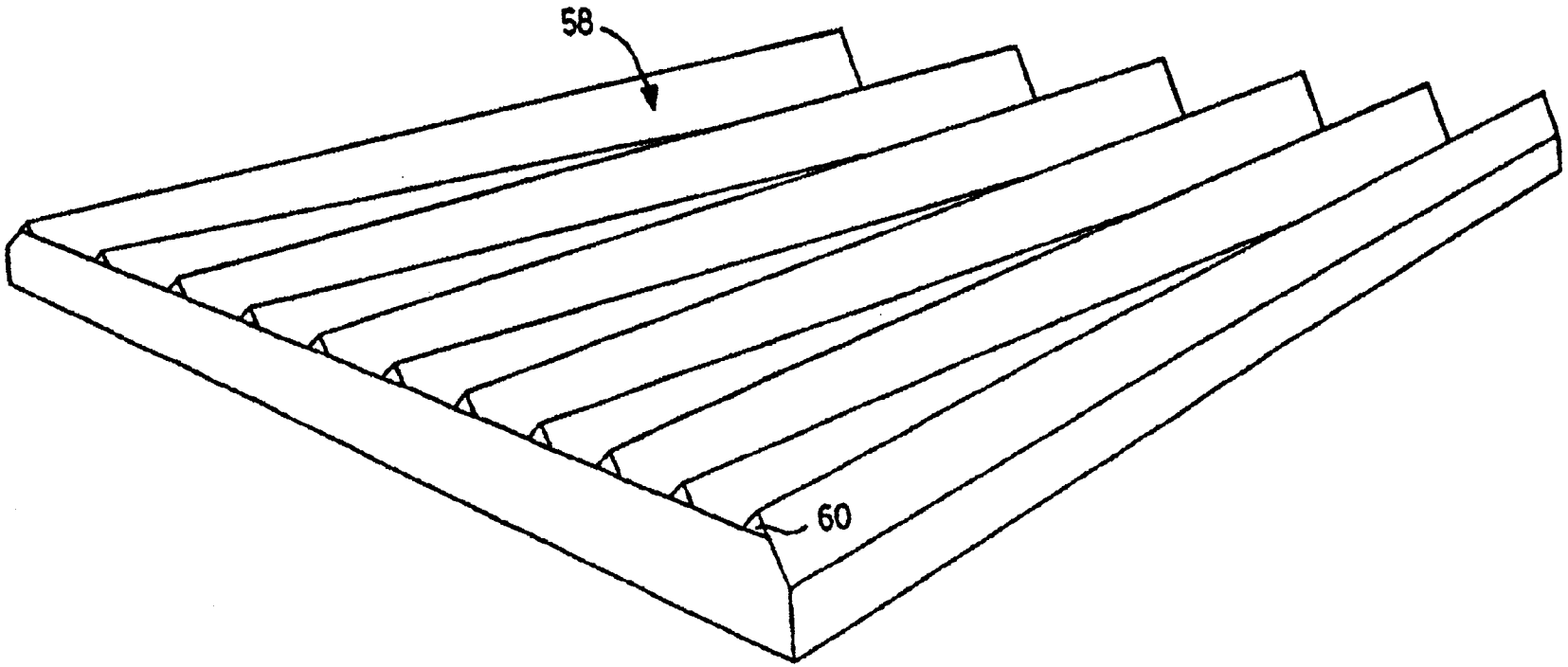
FIG. 3 is a perspective view of a jaw utilized in the crusher shown in FIGS. 1 and 2.

The jaws 46, 48 are shown in more detail in FIG. 3 and are formed with a ridged upper surface 58 having triangular teeth 60 which progressively increase in height and merge from the front to rear. The form of the upper surface 58 is merely exemplary and is a standard form of crusher jaw such as that made by ESCO Canada Ltd. and therefore need not be described in further detail. The bolts 50 are arranged on standard centers so that different forms of crusher jaw can be utilized depending upon the material to be crushed.

Referring once again to FIG. 2, each of the arms 54 has a bracket 62 on the side opposite to the jaws 48 and which extends rearwardly. The bracket 62 has a projecting lug 64 which receives one end of a coil spring 66. The opposite end of the coil spring 66 is supported upon a transverse bar 67 which extends between the side walls 34. The spring 66 is a compression spring which acts to bias the arm 54 about pin 56 to attain the maximum spacing between the jaws 46, 48.

Relative movement between the jaws 46, 48 is controlled by an actuator generally indicated at 68. The actuator 68 includes a hydraulic cylinder 70 and a piston 72 slidable within the cylinder 70. Hydraulic fluid is supplied to a chamber 74 defined between the piston 72 and cylinder 70 through a pipe 76 from a convenient service location upon the vehicle 14. Flow through the pipe 76 is controlled by a valve assembly that causes chamber 74 to expand upon admission of fluid or contract under the influence of the spring 66 upon egress of fluid. The piston 72 has a ball 76 formed at one end that engages a socket 78 mounted on the plate 52. The opposite end of the actuator 68 is domed as indicated at 79 and supported in a part-cylindrical recess 80 formed in a cross-bar 82 extending between the back plate 40 and top plate 42. The ball 76 and socket 78 together with the dome 79 and recess 80 permit relative rotational movement as the arm 54 swings about the pin 56 to inhibit bending stresses upon the actuator.

In operation, the attitude of the crusher 10 is adjusted through the boom assembly 12 such that the floor 36 is flush with the ground upon which a stockpile of stones is located. The vehicle 14 is advanced so that material enters the hopper 32 through an inlet 49 defined between the jaw 48, the side plates 34 and the floor 36. The boom assembly 12 is then crowded to rotate the crusher about the pivot points 28 of the boom 16 so that the stones indicated generally as S fall between the jaws 46,48. Although some of the stone S is sufficiently small to pass between the jaws 46, 48 and out of the outlet 44, the majority is held between the jaws 46, 48. The hydraulic fluid is then supplied through the pipe 76 to expand the chamber 74 and pivot the arm 54 about the pin 56. The jaws move toward one another and crush the stones S located between the jaw causing them to shatter into smaller fragments. Those fragments then pass between the jaws and through the outlet 44 to provide a supply of crushed stone.

The actuator 68 is cycled between extended and retracted positions on a regular basis, typically 60 Hz to provide a continuous crushing operation. The stones S thus feed from the hopper 32 between the jaws 46, 48 and are fragmented to pass out of the outlet 44.

The spring 66 opposes rotational movement of the arm 54 under the influence of the actuator 68 and thus returns the arm to the position in which the jaws 46, 48 are separated. This enables the actuator 68 to be single acting and a relatively simply cycling valve used to supply fluid through the pipe 76.

Once the stone S has been crushed, the vehicle 14 may be repositioned to acquire additional stones and crush them in a similar manner. In the event that a stone S becomes stuck within the jaws, the crowd cylinder 24 may be extended to allow the stone S to drop out of the hopper 32.

It will be seen therefore that by mounting the crusher assembly on the boom 16, it is possible to transport the crusher to a convenient location to perform crushing operations. The provision of the spaced jaws 46, 48 between the inlet 49 and outlet 44 of the hopper 32 enables the stones to be crushed on a continuous basis and to utilize gravity to induce the flow through the crusher jaws. Upon completion of the crushing operation, the hopper 32 may be utilized to transport the crushed material to an appropriate site or may be used to compact and smooth the crushed material in a manner similar to that with a conventional bucket assembly. It will be appreciated that the mounting points may be chosen to conform to one of a standard configuration of machine, for example. the hopper can be configured to be used with a 360° Excavator or with a rear mounted backhoe by suitable positioning of the mounting points.

Figure 4:
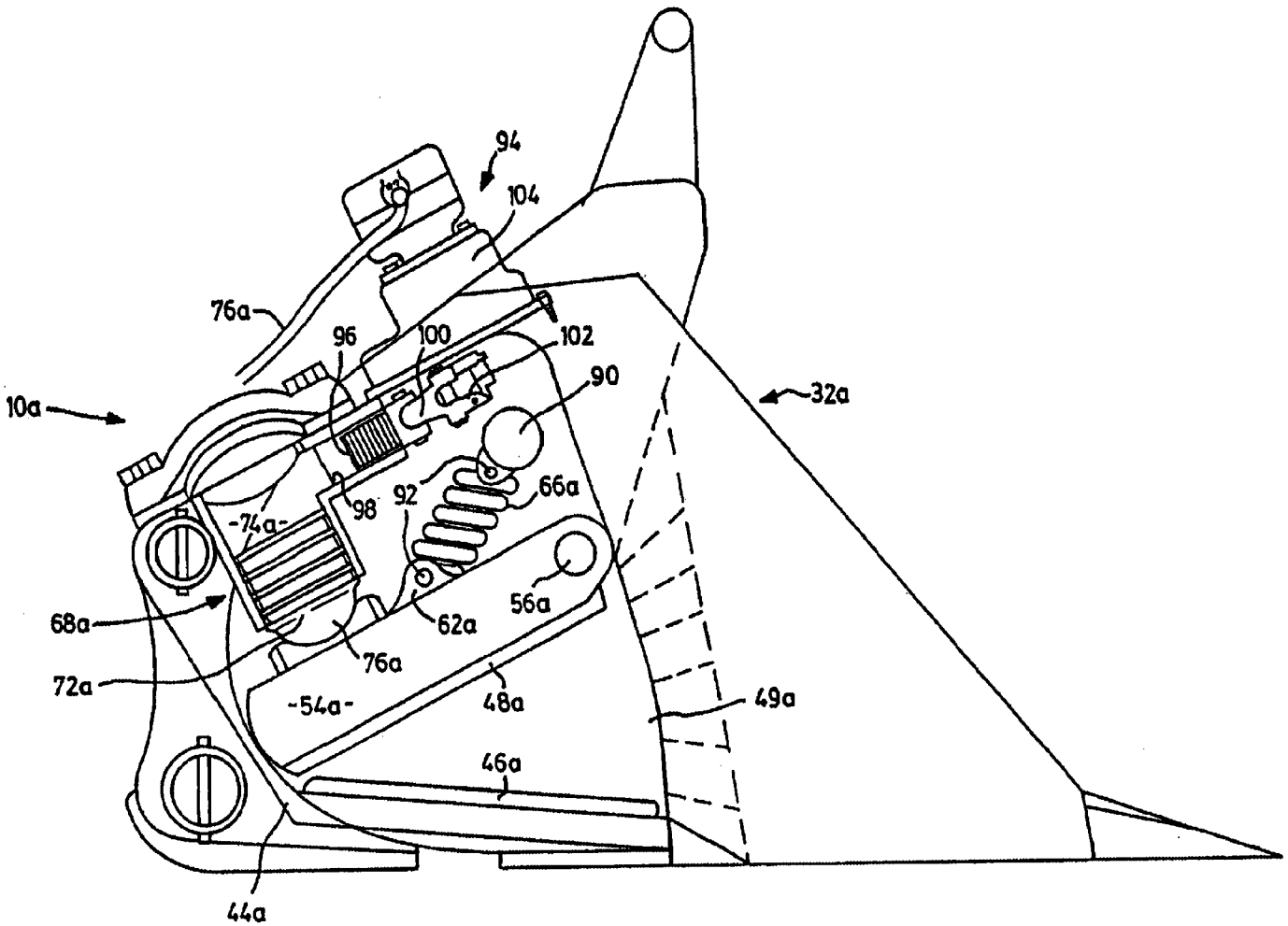
FIG. 4 is a side view similar to FIG. 2 of an alternative embodiment of crusher.

A further embodiment of crusher is shown in FIG. 4 in which like components will be identified with like reference numerals with a suffix "a" added for clarity. In the embodiment of FIG. 4, the crusher **10*a* has a lower jaw 46*a* and an upper jaw 48*a* to direct material from an inlet 49*a* to outlet 44*a* in the rear wall of the hopper 32*a*. Spring 66*a* extends between a bracket 62*a* on the arm 54*a* and a transverse bar 90. The spring 66*a* is a tension spring having hooked ends secured in eyes 92 on the bracket 62*a* and bar 90 respectively. Rotation of the arm 54*a* about the pin 56*a* will cause extension of the spring 66*a* to bias the arm away from the lower jaw 46*a***.

An actuator **68*a* is located within the hopper 32*a* and has a piston 72*a* with a ball 76*a* received in socket 78*a*. Fluid is supplied to a chamber 74*a* from a reciprocating pump generally indicated at 94. The pump 94 has a piston 96 slidable within a cylinder 98 which is directly connected to the chamber 74*a*. The piston 96 is connected to a connecting rod 100. The connecting rod is pivotally secured to a crank 102 which is secured to an output shaft of a hydraulic motor 104. The motor 104 can be of any convenient form and receives hydraulic fluid through pipe 76*a*** from a service on the vehicle.

The operation of the crusher **10*a* is similar to that described above with cyclic extension and retraction of the actuator 68*a* being induced by flow of fluid between the interconnected chambers 98 and 74*a* as the piston 96 reciprocates under the control of the crank 102. The cylinder 98 is sized to produce the requisite stroke for the piston 72*a* and produce the oscillatory motion of the arm 54*a* about the pin 56*a***.

Figure 5:
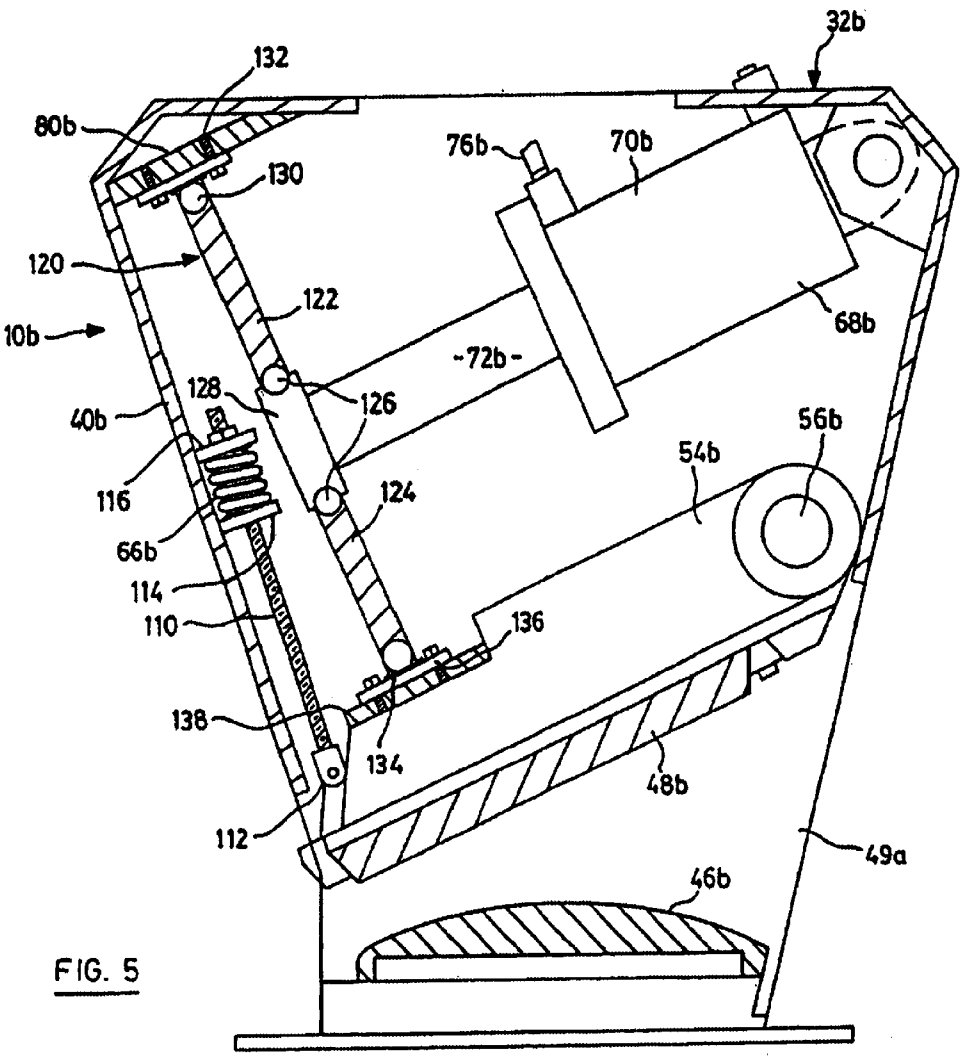
FIG. 5 is a side view similar to FIG. 1 of a still further embodiment of the crusher.

A further embodiment is shown in FIG. 5 in which like reference numerals will again be utilized to denote like components with the suffix "b" added for clarity. The crusher 10*b* has a pair of jaws 46*b*, 48*b* with the upper jaw 48*b* mounted on arm 54*b* to pivot about the pin 56*b*. The arm 54*b* is biased away from the jaw 46*b* by a coil spring 66*b* acting through a rod 110. The rod 110 extends parallel with the back wall 40*b* and is pivotally connected by pin 112 to a tongue 114 on the arm 54*b*. The rod 110 passes through a hole formed in a bracket 114 that is secured to the rear wall 40*b* and the spring 66*b* located between the bracket 114 and a cap 116 threaded onto the rod 110. Pivotal movement of the arm 54*b* will thus cause compression of the spring 56*b* between the bracket 114 and the cap 116.

Rotation of the arm 54*b* is induced through a toggle mechanism generally indicated at 120 connected to an actuator 68*b*. The toggle mechanism 120 includes a pair of links 122, 124 which are pivoted by pins 126 to opposite sides of a boss 128. The opposite end of link 122 is secured through a pin 130 to a bracket 132 on the cross bar 80*b* at the vertex of the hopper 32*b*. The link 124 is similarly connected through pin 134 and plate 136 to the arm 54*b*.

The boss 128 is secured to the piston 72*b* of the actuator 68*b* which in turn is slidable within the cylinder 70*b*. Fluid to the actuator 68*b* is supplied through control pipe 76*b* from suitable valving to cause reciprocation of the piston 72*b* within the cylinder 70*b*.

With the links 122, 124 aligned, the jaw 48*b* is closest to the jaw 46*b*. As the piston rod 72*b* reciprocates, the boss 128 is displaced laterally causing the links 122, 124 to pivot about their respective pin connections and thus cause the arm 54*b* to rotate about the pin 56*b*. A crushing action is thus provided by the cyclic reciprocation of the piston rod within the cylinder 70*b* to reduce the stone S to an aggregate.

The stroke of the actuator 68*b* may be adjusted so that at one limit the links 122, 124 are aligned as shown in FIG. 5 and at the other limit, the boss is displaced as shown by the chain-dotted lines in FIG. 5. An alternative control is to permit the stroke of the actuator 68*b* to move the links 122, 124 past the aligned position so that the boss 128 is moved to either side of the position indicated in chain dot lines. As the links move over center, the jaws will move apart. As a result, two oscillations of the jaws will occur for each stroke of the cylinder.

The initial spacing between the jaws 46*b* and 48*b* can be adjusted by means of spacers indicated at 138 located beneath the plate 136 with a corresponding adjustment made to the position of the cup 116 on the rod 110. In this way, different nominal sized aggregate can be produced.

Figure 6:
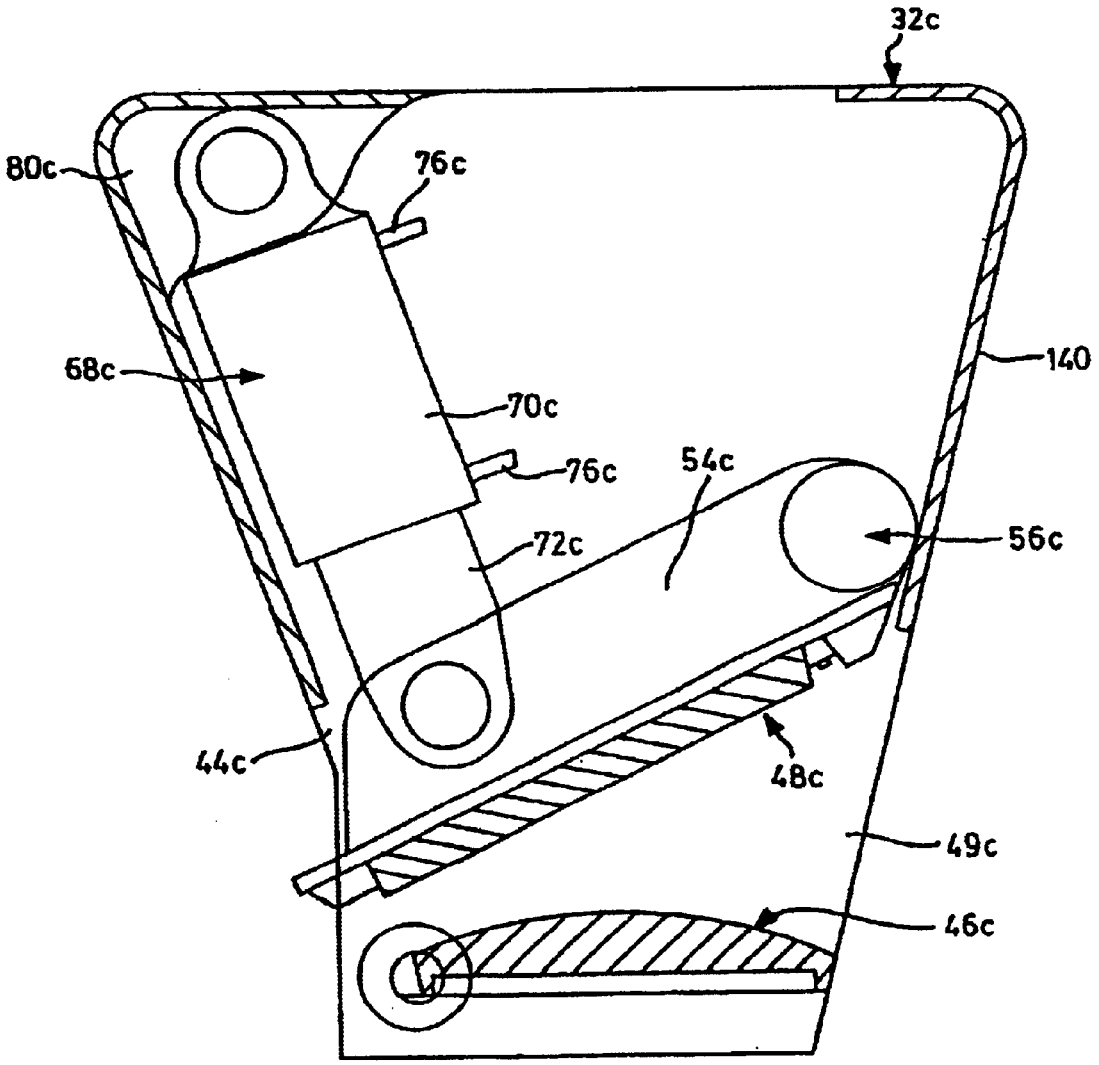
FIG. 6 is a side view similar to FIG. 1 of a yet further embodiment of crusher.

A further embodiment is shown in FIG. 6 in which like components will be identified with like reference numerals with the suffix "c" added for clarity. In the embodiment shown in FIG. 6, actuator 68*c* is in the form of a double-acting hydraulic motor having a piston 72*c* and a cylinder 70*c*. The actuator 68*c* acts directly between the bracket 80*b* and the arm 54*c*. The hopper 32*c* is provided with a front wall 140 that extends from the upper apex of the hopper 32*c* downwardly beyond the pivot pin 56*c*. As such, the front wall 140 shields the actuator 68*c*.

Oscillation of the jaws 46*c* and 48*c* is controlled by the actuator 68*c* which is caused to reciprocate cyclically by fluid supplied from a suitable valve through the pipes 76*c*. The cycling of the actuator 68 can be obtained using one of a number of conventional cycling operations. For example, a spring-biased solenoid-operated valve can be utilized with drive to the solenoid switch by proximity sensors associated with the piston rod or by using a mechanical linkage connected between a reversing valve and the upper jaw 48 to reverse flow to the actuator.

In each of the above arrangements, the typical minimum spacing between the jaws 46*c*, 48*c* is in the order of 2 inches although spacings of up to 3 or more inches can be contemplated where relatively large aggregate is required. Typically the displacement of the jaws between maximum and minimum spacing would be in the order of ½–1 inch to provide the requisite crushing action. As noted above, the actuator 68 produces an oscillatory motion in the order of 60 Hz through suitable valving. Using a 10" diameter cylinder, adequate crushing force is obtained at 500 psi.

It will be seen therefore that by providing a compact mechanism located within a hopper that may be attached to an earthmoving vehicle, a portable crusher is provided that can be used at remote locations to facilitate the production of aggregate.

Although the invention has been described with reference to certain specific embodiments, various modifications thereof will be apparent to those skilled in the art without departing from the spirit and scope of the invention as outlined in the claims appended hereto.

What is claimed is:

1. A portable crusher comprising:

a hopper having a material inlet and material outlet spaced from said inlet;

a pair of jaws within said hopper positioned between said inlet and outlet, said jaws being movable relative to one another, whereby material moving from said inlet to said outlet passes between said jaws and is crushed by said jaws, said pair of jaws comprising a first, stationary jaw, and a second, moveable jaw having a first end pivotally coupled to said hopper at said inlet and a second end near said outlet coupled to an actuator via a toggle;

said actuator comprising a cylinder and a piston slidable within said cylinder to affect said relative movement between said jaws:

said toggle comprising a first link pivotally couple to said piston and said second jaw and a second link pivotally coupled to said piston and said hopper, wherein movement of said piston through a predetermined distance past an aligned position, at which said first link is aligned with said second link, yields two opening oscillations and one crushing oscillation of said moveable jaw for each stroke of said actuator, which yields two different sizes of the jaw outlet for crushed material.

2. The crusher of claim 1 wherein said crusher is adapted for attachment to an earthmoving vehicle.

3. The crusher of claim 1 wherein said first jaw is further connected to a biasing means for maintaining separation between said first and second jaws.

4. The crusher of claim 3 wherein said biasing means comprises a spring.

* * * * *